US005209780A

United States Patent [19]

Partel

[11] Patent Number: 5,209,780

[45] Date of Patent: May 11, 1993

[54] APPARATUS FOR TREATING THE UNDERSIDE TRAVEL FACES OF SKIS

[76] Inventor: Georg Partel, Gardis 14, A-6833 Weiler, Austria

[21] Appl. No.: 640,379

[22] PCT Filed: Jun. 11, 1990

[86] PCT No.: PCT/EP90/00911

§ 371 Date: Feb. 1, 1991

§ 102(e) Date: Feb. 1, 1991

[87] PCT Pub. No.: WO90/15646

PCT Pub. Date: Dec. 27, 1990

[30] Foreign Application Priority Data

Jun. 15, 1989 [AT] Austria ..... 1467/89
Jul. 4, 1989 [AT] Austria ..... 1631/89

[51] Int. Cl.[5] ..... B05C 5/02; B05C 9/14; B05C 13/02

[52] U.S. Cl. ..... 118/59; 118/72; 118/202; 118/242; 118/256; 118/410; 118/421

[58] Field of Search ..... 118/411, 410, 59, 72, 118/202, 421, 428, 314, 315, 323, 225, 242, 255, 256

[56] References Cited

U.S. PATENT DOCUMENTS

| | | | |
|---|---|---|---|
| 2,537,511 | 1/1951 | Coulombe | 118/239 |
| 3,045,639 | 7/1962 | Kurlander et al. | 118/72 |
| 3,136,659 | 6/1964 | Walker et al. | 118/258 |
| 3,425,394 | 2/1969 | Rey | 118/72 X |
| 4,118,130 | 10/1978 | Kasubke et al. | 118/710 X |
| 4,717,601 | 1/1988 | Bocquet | 118/72 X |
| 4,905,625 | 3/1990 | Funke | 118/258 |
| 5,012,758 | 5/1991 | Künzler | 118/72 X |
| 5,018,477 | 5/1991 | Amann | 118/72 |

FOREIGN PATENT DOCUMENTS

| | | |
|---|---|---|
| 1578879 | 10/1971 | Fed. Rep. of Germany . |
| 8101204 | 6/1981 | Fed. Rep. of Germany . |
| 3143443 | 5/1983 | Fed. Rep. of Germany . |
| 3234963 | 3/1984 | Fed. Rep. of Germany . |
| 3234964 | 3/1984 | Fed. Rep. of Germany . |
| 3237753 | 4/1984 | Fed. Rep. of Germany . |
| 3249449 | 7/1984 | Fed. Rep. of Germany . |
| 3639427 | 5/1988 | Fed. Rep. of Germany . |
| 8816113 | 5/1989 | Fed. Rep. of Germany . |
| 3741074 | 6/1989 | Fed. Rep. of Germany . |
| 570180 | 12/1975 | Switzerland . |
| 670770 | 7/1989 | Switzerland . |
| 1209312 | 9/1984 | U.S.S.R. . |

*Primary Examiner*—Michael G. Wityshyn
*Attorney, Agent, or Firm*—Anderson Kill Olick & Oshinsky

[57] ABSTRACT

The apparatus serves for treatment of the undersides of skis and comprises a housing (1) which can be entered by the skier with strapped-on skis, comprising a treatment arrangement for cleaning, drying, wax application and heating. Supports or backup organs are provided which support the skis (22) during the treatment of their underside, as well as a driving arrangement for generation of a relative motion between the underside of the skis and the treatment arrangement. Support organs are formed by freely rotatable rollers arranged to be parallel to each other. Their axes (11) are held on their ends in an essentially horizontal guide (9) and are connected with the chain-like conveyor members (8). The treatment arrangement or the frame (13) supporting same is also connected with the chain-like conveyor members (8). Rollers (12) are arranged upstream as well as downstream of the treatment arrangement or the frame (13) carrying the same, and the conveyor members (8) displace the rollers (12) and the treatment arrangement along the guide (9). The horizontal guide (9) for the freely rotatable rollers (12) serving as support organs is approximately twice as long as the length of the longest ski (22) to be treated.

14 Claims, 2 Drawing Sheets

1
2
3
4
5
6
7
8
9
12
13
14
15
16
17
18
19
20
22
II
II 8
9
12
14
15
16
17
18
19
20
22
25
26
27
28
29
30
31
32

19
33
34

1
8
9
10
11
12
21
22
23
24
B

APPARATUS FOR TREATING THE UNDERSIDE TRAVEL FACES OF SKIS

FIELD OF THE INVENTION

The invention is directed to an apparatus for treating the underside face of skis.

BACKGROUND OF THE INVENTION

Arrangements of this sort are known. Such an arrangement comprises a housing which can be entered by skiers with strapped-on skis, where an upper working aperture is formed with sufficient room for both skis next to each other. Support members in the shape of swiveling plates spaced longitudinally project from both sides of the housing into the aperture, upon which members the skis are respectively abutted. A working trolley is guided in the housing itself so as to be longitudinally mobile and motor driven, wherein the treatment arrangements for the undersides of the skis are located. During passage of the trolley the support members are swiveled out of the trolley's path and after the trolley has passed they again swing back into their support position. The skier maintains his position with respect to the apparatus (DE-OS 32 27 922, U.S. Pat. No. 4 457 255) during the entire treatment process. The trolley contains a container divided into several compartments. Rollers rotatably supported around a transverse axis are supported in the compartments, for instance a cleaning roller plunging into a liquid bath, as well as a wax application roller plunging into a wax reservoir; both these rollers can be heated. The trolley contains the additional ski underside treatment arrangements, such as the heating arrangement, blower, polishing roller, drying device, scrape-off device, possibly an edge-grinding device etc. This design is very expensive. The large quantity of existing swiveling plates must indeed not only swivel, rather they also must be supported so as to be additionally raisable and lowerable, which requires a plurality of joints, which makes the design complicated and expensive and in addition malfunction-prone; it must also be taken into account, that such arrangements as a rule are operated outdoors if indeed however under a covering.

The coating arrangements of this type are also provided in such apparatus for waxing skis, where the reservoir for the wax supply and the coating rollers plunging into same are supported in a housing so as to be stationary therein and the skier together with his skis is pulled or directed across this coating arrangement by means of conveyor rollers. In these previously known arrangements the wax is brought to the underside of the skis by a rotation of the roller and applied there by means of a coating roller plunging into the wax reservoir. In actual practice it was seen that this type of coating is not devoid of problems, since the wax thickness is often very uneven to the extgent that partially there is no coating at all.

Furthermore, such apparatus for waxing a ski must be mentioned, where a stationary wax container is placed in a housing into which projects a rotatably supported coating roller. Backup rollers are provided on both sides of the stationary container of the liquid wax, whose axes are also supported to be stationary in the housing, which rollers are however driven as conveyor rollers. The skier who steps with strapped-on skis on these rotatable conveyor rollers is pushed across the coating rollers. Compared to the previously known and previously mentioned design, this type of apparatus for waxing skis is indeed designed to be more simply constructed, however it has been shown that the wax application is unsatisfactory in this previously known apparatus.

A ski waxing apparatus which can be entered is also known from the DE-OS 3249 449, which has an elongated box-shaped housing with a cover plate comprising two guidance tracks for the skis. Stationary brushes are rotatably supported in the housing. A shifting arrangement for the skis is furthermore provided with a conveyor belt endlessly revolving in a vertical plane around two reversing rollers, with a support arm being fastened at the conveyor belt. This support arm is movable by the revolving conveyor belt in a longitudinal slot provided between the guide tracks and it carries a driver, which comes to rest at the rear ends of the skis and thereupon pushes the skis together with the skier across the guide tracks. The wax coating arrangement is stationarily arranged in the main housing. The guide tracks for the skis are defined by side metal plates. This arrangement is not advisable, indeed for several reasons: the skier enters with strapped-on skis into the guide tracks bounded on the sides, is then pushed by a driver engaging at the ends of the skis. Since the conveyor belt or the conveyor chain which moves this driver must necessarily have a uniform revolution velocity, this revolution velocity can only be very low, since the driver must indeed accelerate the skier entering the guide tracks up to the velocity of revolution of the conveyor device. Furthermore the pushing force is applied at the end of the ski, thus extremely eccentrically referred to the center of gravity of the skier. The skis are so-to-speak pushed out from under the feet of the skier, and this in addition in a jerk-like fashion because of the uniformly revolving driver. This as a rule leads necessarily to falls or tumbles especially with inexperienced skiers. Since a skier when pushed, by experience executes lateral movements with the skis in order to maintain his balance, the skis thus being moved around their longitudinal axis and this naturally also in the course of the passage over the wax coating apparatus, the wax or the sliding agent or lubricant is necessarily applied unevenly upon the underside of the ski. All these considerations are also valid in the case of the arrangement in DE-OS 3 237 753. The ski waxing apparatus shown and described there differs only slightly from the one which was discussed at the start.

The CH-PS 570 182 shows and describes also a detail of a ski waxing apparatus. In a box-like housing several powered rollers arranged to be parallel to each other are supported, which with the exception of one pair of rollers are stationary in the housing. The one pair of rollers is abutted by springs in vertical direction. The skier pushed across the ski waxing appliance by the rotating rollers presses, while overcoming the force of the above-mentioned spring, this pair of rollers somewhat downward, whereby a switching process is triggered, by means of which subsequently wax is sprayed upward by nozzles directed against the underside of the ski.

Finally the ski waxing appliance in the U.S. Pat. No. 2537 511 must be mentioned. Here two conveyor belts are supported in an elongated housing, which referred to their conveyance direction are arranged one behind the other. A stationary wax application device is mounted inside the housing between these two conveyor belts.

It is common to all discussed ski coating appliances, that the skier with strapped-on skis is moved over a stationary application device, be it by a driver engaging at the end of the skis, be it by rotating conveyor rollers or else conveyor belts. The disadvantages demonstrated in connection with the arrangements discussed above are common to these known appliances; the pulled or pushed skier moves, necessarily in order to keep his balance, the skies around their longitudinal axis, because of that the wax is unevenly applied to the underside traveling sole of the skis. Apart from this the motion imparted by the conveyor means to the skier easily causes him to tumble, above all if we are dealing with a skier having very little experience and if the pushing force causing the motion engages extremely eccentrically with reference to the CG of the skier, thus directly at the skis themselves.

SUMMARY OF THE INVENTION

The invention proceeds from this state of the art aiming to improve the coating apparatus wherein the skis can be supported in a simple manner during the treatment, without thereby affecting the treatment especially the wax application.

The subject invention indicates herein a new way of eliminating a disadvantages of the known arrangements. It proceeds from the consideration that the skier stands still during the wax application process, thus no conveyance- or pushing forces act upon him, which could very easily make him tumble and that, as a consequence precisely this "static behavior" of the skier, his skis stand or lie without motion, so that now the wax application device guided along the ski is faced with explicitly defined conditions in executing its intended function, so that the wax can be evenly applied across the entire length and width of the ski. The present invention is based upon the same considerations as far as these aspects are concerned as the ski wax application device in the DE-PS 3227 922.

BRIEF DESCRIPTION OF THE DRAWINGS

The drawing illustrates an embodiment example of the invention. It is shown on:

FIG. 1 a diagrammatic longitudinal section through the apparatus and in

DESCRIPTION OF THE PREFERRED EMBODIMENT

Figure 1:
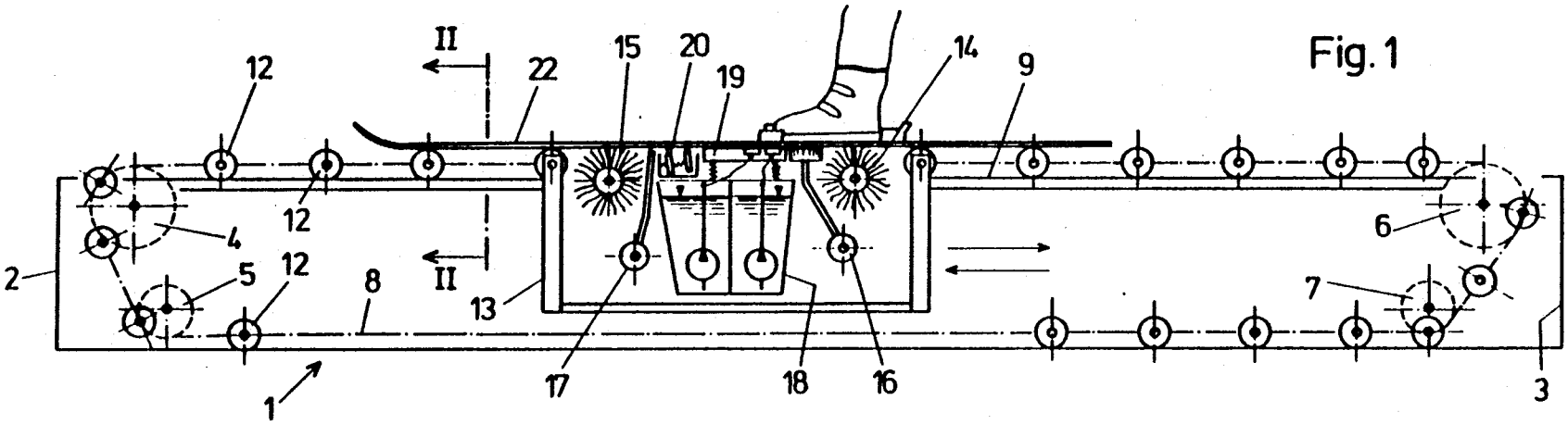

The drive wheels 4 and reversing wheels 5, 6 and 7 are respectively arranged in pairs in the area of the narrow end faces 2 and 3 in an elongated narrow housing 1 open at the top; endless conveyor members 8 in this case in the form of chains are guided above said drive and reversing wheels. These wheels 4, 5, 6 and 7 have horizontally positioned axes and the endless conveyor members 8 provided in pairs lie in vertical planes (FIG. 2). The guides 9 extend along the upper longitudinal sides of the housing 1, with support rollers 10 traveling in the guides with the ends of the support rollers being arranged at the axes 11 of the freely rotatable rollers 12. Such rollers 12 are provided in larger quantities and spaced from each other and are connected with each other by means of the endless conveyor members 8. The housing frame 13 is also fastened at these two conveyor members 8 and is guided in the rails 9, with the installations provided for treatment of the ski underside or ski sliding faces, for instance a cleaning brush 14, a polishing brush 15, a hot blower 16, a cold air blower 17, a heatable wax reservoir 18 with a wax application device 19 and a wiper 20 being located in said housing frame. The endless conveyor member 8 which in this case is a chain, is, as can be seen from FIG. 1, equipped with rollers 12 only across a portion of its length, wherein these rollers 12 are arranged upstream as well as downstream of the treatment device or the housing frame 13.

Clamping abutments 21 are arranged above the rollers 12 (see FIG. 2) actually in the central region, with the side edges 23 of said clamping abutments being beveled to extend downwards in a wedge-shaped manner. These beveled side edges 23 converge towards the bottom. These clamping abutments 21 are arranged to be stationary in the housing 1 and cooperate with clamping jaws 24 which can be actuated for instance pneumatically. The housing 1 is approximately twice as long as the greatest length of the largest ski to be treated.

Steel cables or band can be used instead of chains by way of conveyor members 8. Instead of endless conveyor members 8 (see FIG. 1) conveyor elements 8 can also be used which are designed to be finite, wherein rather then no reversing wheels, reel-up rollers are provided at the narrow end faces of the housing 1.

The apparatus described above is erected outdoors, preferably however protected by a roof, and is equipped with a drive and control device, which however is not shown here. A motor is provided for driving drive wheels 4, which is preferably in effective connection with a coin operated automatic meter. In the initial- and non-operating position, the mounting frame 13 is located at the left end of the housing 1 (FIG. 1), so that the upper aperture of the housing 1 is covered and spanned by rollers 12 across its entire length. The skier arriving in FIG. 1 from the righthand side enters upon these rollers and is then directed into the central region of the apparatus (FIG. 1) by optical and/or mechanical instruction assists. By inserting a coin in the meter the apparatus is made to operate, wherein to begin with the mounting frame 13 located on the left side (FIG. 1) is pulled towards the right by the endless conveyor member 8, wherein the rollers 12 which are supported and guided on their edges travel beneath the ski and carry same, wherein simultaneously the underside of the ski is worked on and waxed by means of the treatment arrangement located in the mounting frame. The clamping member 21 is provided in the central region of the rollers 12, whose side edges 23 are beveled in a wedge-shaped manner and converge towards the bottom. Clamping jaws 24 act from the outer side, preferably actuated pneumatically, and press the skis 22 supported by the rollers 12 against the side edges 23, wherein their beveled shape takes care of the proper positioning of the skis. When the mounting frame 31 has traveled across the entire length of the skis and is now located in its righthand (FIG. 1) end position within the housing 1, it then reverts to its initial position, as soon as the skier has left the installation, since the conveyor member 8 in spite of its endless design in this case performs only a reciprocating motion. This apparatus could also be designed in such a way, that the endless conveyor member 8 moves exclusively in one direction. This however would assume that the housing 1 is constructed to be higher so that sufficient room for the respective return is available below for the mounting frame 13. Instead of an endless conveyor member 8 a conveyor member with ends can be provided wherein reel-up rollers must be arranged at both narrow end faces 2 and 3 of the housing 1.

The apparatus is equipped with a program control, which assures that, after the drive motor has been switched on in order to power the drive wheel 4, the individual actuation devices occur in the chronologically correct sequence, as soon as the skis have been clamped and the drive motor has begun to operate.

It can be seen from the above description and also from FIG. 2 that the freely rotatable rollers 12 serving as backup organs are designed in a single piece across the width of the housing 1. Basically it is naturally possible to subdivide these rollers across their axial length, so that the backup organ across the width B of the housing 1 consists of a plurality of individual rollers. This however would increase the cost.

In the embodiment examples shown the guides 9 are designed as U-shaped rails open towards the top. In order to prevent penetration of foreign bodies and extraneous material into these guide rails 9 or at least to impede same, the upper edges of the housing are extended across these guide rails, as FIG. 2 illustrates. In addition, it would also be possible to use C-shaped guide rails open towards the side instead of U-rails open towards the duct.

As was explained above, the clamping abutments 21 are arranged to be stationary and the external clamping jaws 24 are supported in a mobile manner, it is within the framework of the invention to reverse this arrangement kinematically, meaning to provide the mobile clamping jaws on the inside and the stationary abutments on the outside. Instead of a pneumatic actuation of the mobile clamping jaws other actuation devices (spindle drives; hydraulic drives; lever linkage) could be provided.

Figure 3:
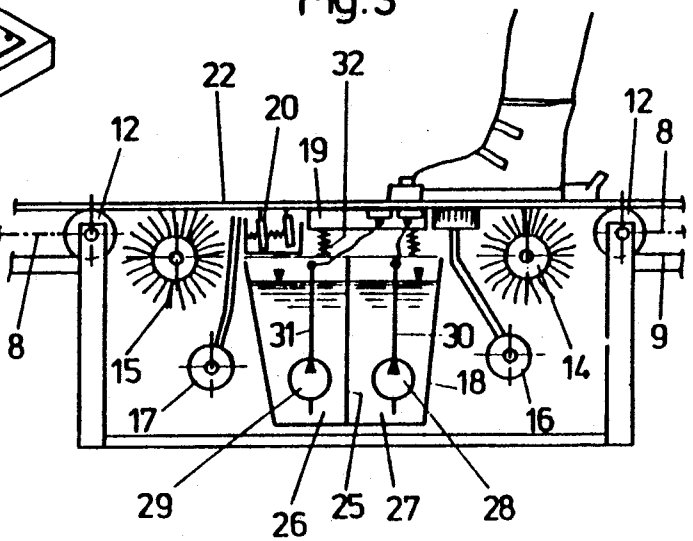
FIG. 3 shows the mounting frame with the treatment arrangements at a scale magnified compared to that in FIG. 1
Figure 4:
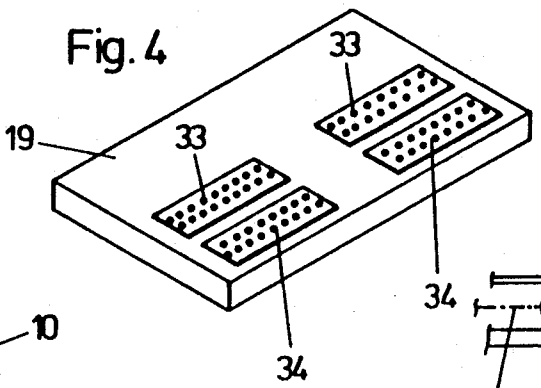
FIG. 4 shows the heatable plate in oblique top view.
Figure 2:
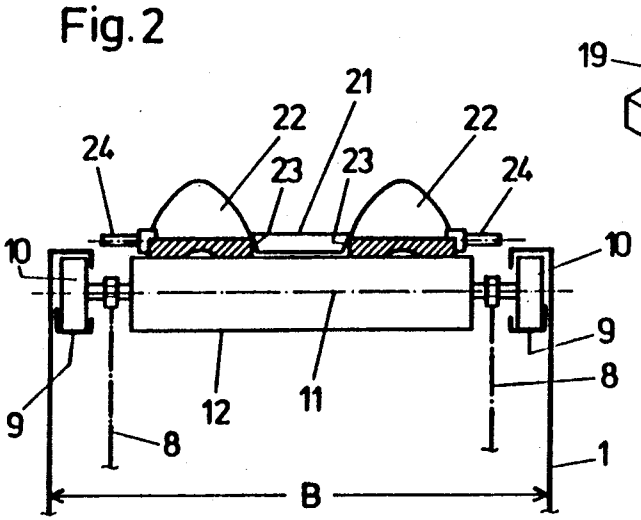
FIG. 2 a cross-section along the line II—II in FIG. 1 at a scale magnified compared to that in FIG. 1.

FIG. 3 shows the mounting frame 13 at a larger scale compared to FIG. 1. The reservoir 18 is here subdivided by a separation wall 25 into two chambers 26 and 27, both chambers are heated. A pump 28 and 29 is assigned to each of these chambers, from which pumps tube or hose lines 30, 31 lead to a heated metal plate 19, which has flat pan-like depressions 33, 34 on its top side, into which the mentioned hoses or tubes discharge from below. With reference to the relative direction of motion between the skis and plate 19 these pan-like depressions 33 and 34 are located in the front segment of the heated plate 19. In actual operation this heated plate 19 rests under spring pressure 32 at the traveling underside of the ski 22 to be treated. A plurality of nozzle bores are configured in the bottom of the pan-like depressions 33 and 34, which are represented by points in FIG. 4 and through which the hot low viscosity liquid wax is sprayed on the underside of the ski. The pumps 28 and 29 are configured as submerged pumps and are located in the mass of liquid wax.

Figure 5:
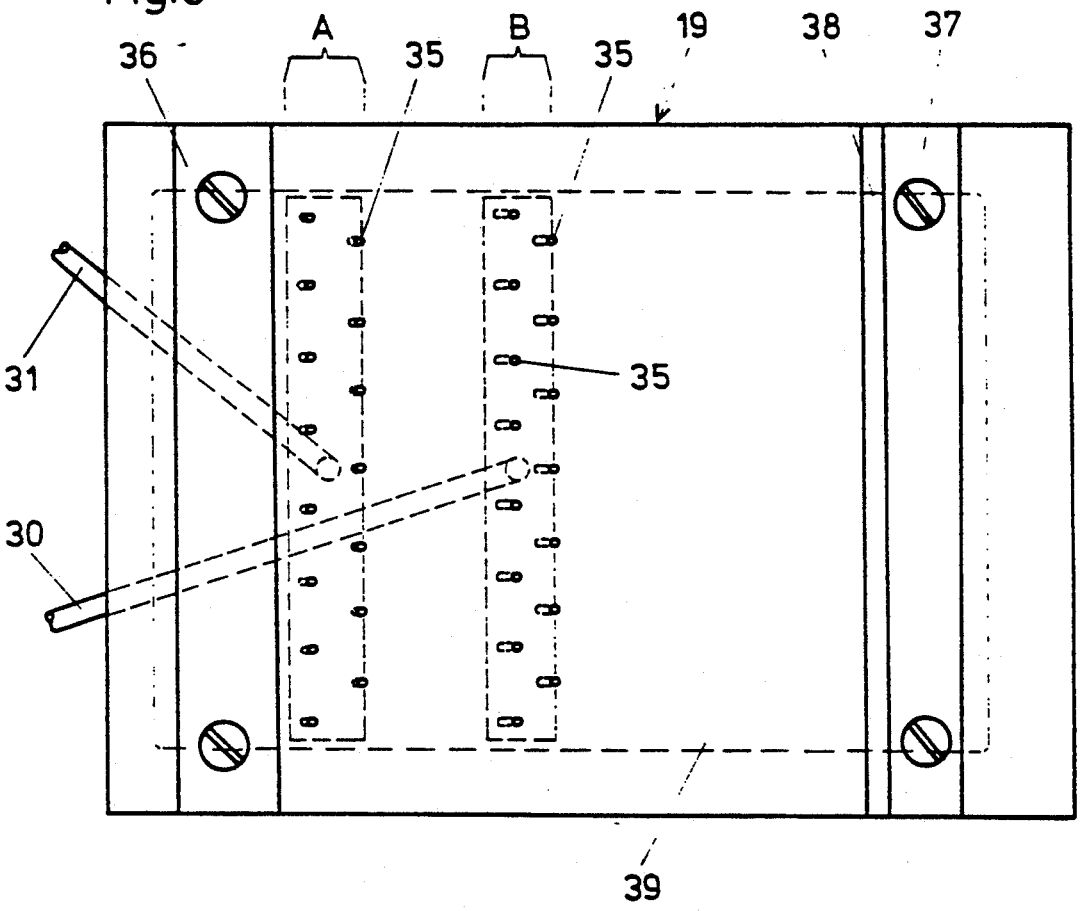
FIG. 5 shows another embodiment form of the heatable plate.
Figure 6:
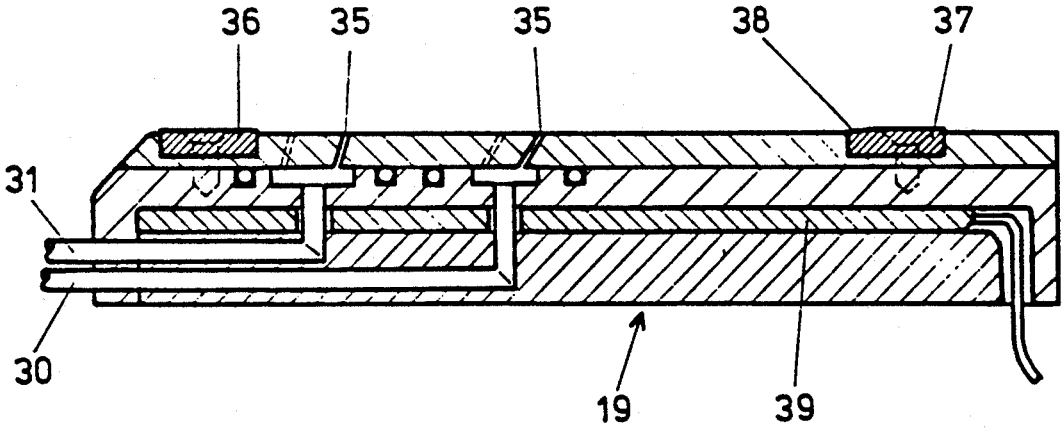
FIG. 6 a longitudinal section through said plate.

An appropriate design of the heated plate 19 is shown in FIG. 5 in plan view and FIG. 6 in longitudinal section. The plate 19 has two groups A and B of nozzle-like wax outlet apertures 35 which are arranged consecutively viewed in direction of motion of the plate 19. The axes of these wax outlet apertures 35 are slightly inclined (FIG. 6) and enclose an acute angle with the relative direction of motion of the ski. Each of the groups A and B is connected with tubing 30 or 31 through which the liquid wax is directed from the chambers 26 and 27 to these wax outlet apertures. Cross ties 36 and 37 are arranged at the two end segments of the plate 19 on its top side, in between which the two mentioned groups A and B of the nozzle-like wax outlet apertures 35 are located. These cross ties are made from a low friction material and serve as supports for the skis. The upper edge of these cross ties 36 and 37 is located by a slight amount above the top side of the plate 19. The side boundary face 38 of the one cross tie 37 is appropriately slightly beveled, thus forming a wedge space with the ski face passing thereon, which promotes the application of wax. In FIG. 6, which shows a longitudinal section through the heated plate 19, there appears additionally the heating element 39.

The additional units provided within the mounting frame, such as cleaning brush 14, polishing brush 15, hot air blower 16, cold air blower 17 and wiper 20 correspond essentially to those design parts, as they have already been previously known in other wax application arrangements.

If the apparatus is made to operate in the above-described manner by a skier, then we can select from two types of wax by pressing a button, depending on the snow- and weather conditions. The desired wax is then sprayed at high pressure from the previously mentioned nozzles and is herein uniformly distributed across the underside of the ski, wherein the heated plate 19 assumes a sort of hot iron function, by uniformly distributing and "ironing" with its hot surface the sprayed-on wax. The reservoir for the wax can be designed to be replaceable, in order to be thus able to change the wax rapidly. A container is appropriately arranged beneath the wiper 20, which accepts the excess wiped-off wax. Such a container is outlined in the present drawing.

I claim:

1. An apparatus for treating a traveling underside of skis comprising:

a housing which can be mounted by a skier with strapped-on skis which further comprises:

a treatment arrangement for cleaning, drying applying wax to and heating an underside of said skis;

support arrangements which support said skis during a treatment of said underside of said skis, wherein a drive arrangement, for generation of relative motion between said traveling undersides of said skis in a longitudinal direction, and of said treatment arrangement is provided, with said treatment arrangement comprising:

at least one heatable reservoir for wax storage;

a heated plate which can be applied to said underside of said skis which is provided for wax application, with at least one was outlet aperture being arranged at a top side of said heated plate, wherein said at least one outlet is connected with at least one of said heatable reservoirs for wax storage through one of a tubing and hose lines and a pump, and further wherein support organs are formed by several rotatable rollers arranged to be parallel to each other, wherein said rollers are arranged upstream as well as downstream of said treatment arrangement, wherein said rollers are supported so as to be freely rotatable with the axes of rotation of said rollers being supported at their ends in essentially horizontal guides and are connected with conveyor members which are one of cables, bands and chains and further wherein one of said treatment arrangement and a frame carrying said treatment arrangement is also connected with said conveyor members and that said rollers and one of said treatment arrangement and said frame is displaceable along said guides by means of said conveyor members.

wherein said horizontal guide for said rollers, which are freely rotatable, and which serve as one of support and backup organs, is approximately twice as long as a length of a longest ski to be treated.

2. An apparatus for treating a traveling underside of skis comprising:

a housing which can be mounted by a skier with strapped-on skis which further comprises:

a treatment arrangement for cleaning, drying, applying wax to and heating an underside of said skis;

support arrangements which support said skis during a treatment of said underside of said skis, wherein a drive arrangement, for generation of relative motion between said traveling undersides of said skis in a longitudinal direction, and of said treatment arrangement is provided, with said treatment arrangement comprising:

at least one heatable reservoir for wax storage;

a heated plate which can be applied to said underside of said skis which is provided for wax application, with at least one wax outlet aperture being arranged at a top side of said heated plate, wherein said at least one outlet is connected with at least one of said heatable reservoirs for wax storage through one of a tubing and hose lines and a pump, and further wherein support organs are formed by several rotatable rollers arranged to be parallel to each other, wherein said rollers are arranged upstream as well as downstream of sad treatment arrangement, wherein said rollers are supported so as to be freely rotatable with the axes of rotation of said rollers being supported at their ends in essentially horizontal guides and are connected with conveyor members which are one of cables, bands and chains and further wherein one of said treatment arrangement and a frame carrying said treatment arrangement is also connected with said conveyor members and that said rollers and one of said treatment arrangement and said frame is displaceable along said guides by means of said conveyor members;

wherein ends of axes of rotation of said rollers, which are freely rotatable, carry one of support and backup rollers which are received by said horizontal guides.

3. An apparatus for treating a traveling underside of skis comprising:

a housing which can be mounted by a skier with strapped-on skis which further comprises:

a treatment arrangement for cleaning, drying, applying wax to, and heating an underside of said skis;

support arrangements which support said skis during a treatment of said underside of said skis, wherein a drive arrangement, for generation of relative motion between said traveling undersides of said skis in a longitudinal direction, and of said treatment arrangement is provided, with said treatment arrangement comprising:

at least one heatable reservoir for wax storage;

a heated plate which can be applied to said underside of said skis which is provided for wax application, with at least one wax outlet aperture being arranged at a top side of said heated plate, wherein said at least one outlet is connected with at least one of said heatable reservoirs for wax storage through one of a tubing and hose lines and a pump, and further wherein support organs are formed by several rotatable rollers arranged to be parallel to each other, wherein sad rollers are arranged upstream as well as downstream of said treatment arrangement, wherein said rollers are supported so as to be freely rotatable with the axes of rotation of said rollers being supported at their ends in essentially horizontal guides and are connected with conveyor members which are one of cables, bands and chains and further wherein one of said treatment arrangement and a frame carrying said treatment arrangement is also connected with said conveyor members and that said rollers and one of said treatment arrangement and said frame is displaceable along said guides by means of said conveyor members.

4. An apparatus for treating a traveling underside of skis comprising:

a housing which can be mounted by a skier with strapped-on skis which further comprises:

a treatment arrangement for cleaning, drying, applying wax to, and heating an underside of said skis;

support arrangements which support said skis during a treatment of said underside of said skis, wherein a drive arrangement, for generation of relative motion between said traveling undersides of said skis in a longitudinal direction, and of said treatment arrangement is provided, with said treatment arrangement comprising:

at least one heatable reservoir for wax storage;

a heated plate which can be applied to said underside of said skis which is provided for wax application, with at least one wax outlet aperture being arranged at a top side of said heated plate, wherein said at least one outlet is connected with at least one of said heatable reservoirs for wax storage through one of a tubing and hose lines and a pump, and further wherein support organs are formed by several rotatable rollers arranged to be parallel to each other, wherein said rollers are arranged upstream as well as downstream of said treatment arrangement, wherein said rollers are supported so as to be freely rotatable with the axes of rotation of said rollers being supported at their ends in essentially horizontal guides and are connected with conveyor members which are one of cables, bands and chains and further wherein one of said treatment arrangement and a frame carrying said treatment arrangement is also connected with sad conveyor members and that said rollers and one of said treatment arrangement and said frame is displaceable along said guides by means of said conveyor members;

wherein said conveyor members are designed to be endless and are arranged in pairs next to each other, and further wherein said conveyor members which revolve in vertical planes are guided by means of one of drive and reversing wheels.

5. The apparatus of any of claims 3 or 4, wherein said conveyor members are connected with said rollers, which are freely rotatable, only across a length portion of sad conveyor members and further wherein said conveyor members perform a reciprocating motion during said conveyor member operation.

6. The apparatus of claim 5, wherein clamping abutments are provided for holding said skis during treatment of the traveling undersides of said skis above said freely rotatable rollers wherein, contact faces of said clamping abutments for said skis are beveled in a wedge-shaped manner and cooperate with clamping jaws.

7. An apparatus for treating a traveling underside of skis comprising:

a housing which can be mounted by a skier with strapped-on skis which further comprises:

a treatment arrangement for cleaning, drying, applying wax to, and heating an underside of said skis;

support arrangements which support said skis during a treatment of said underside of said skis, wherein a drive arrangement, for generation of relative motion between said traveling undersides of said skis in a longitudinal direction, and of said treatment arrangement is provided, with said treatment arrangement comprising:

at least one heatable reservoir for wax storage;

wherein support organs are formed by several rotatable rollers arranged to be parallel to each other, wherein said rollers are arranged upstream as well as downstream of said treatment arrangement, and further wherein said rollers are supported so as to be freely rotatable with the axes of rotation of said rollers being supported at their ends in essentially horizontal guides and are connected with conveyor members which are one of cables, bands and chains and wherein one of said treatment arrangement and a frame carrying said treatment arrangement is also connected with said conveyor members and wherein said rollers and one of said treatment arrangement and said frame is displaceable along said guides by said conveyor members.

8. The apparatus of claim 7 wherein said horizontal guides for said rollers, which are freely rotatable, and which serve as one of support and backup organs, are approximately twice as long as a length of a longest ski to be treated.

9. The apparatus of claim 7 wherein ends of the axes of rotation of said rollers, which are freely rotatable, carry one of support and backup rollers which are received by said horizontal guides.

10. The apparatus of claim 7 wherein said conveyor members are designed to be endless and are arranged in pairs next to each other, and further wherein said conveyor members which revolve in vertical planes are guided by means of one of drive and reversing wheels.

11. The apparatus of any of claims 7 or 10, wherein said conveyor members are connected with said rollers, which are freely rotatable, only across a length portion of said conveyor members, and further wherein said conveyor members perform a reciprocating motion during said conveyor member operation.

12. The apparatus of claim 11, wherein clamping abutments are provided for holding said skis during treatment of the traveling undersides of said skis above said freely rotatable rollers wherein, contact faces of said clamping abutments for said skis are beveled in a wedge-shaped manner and cooperate with clamping jaws.

13. The apparatus of any one of claims 2–10 wherein clamping abutments are provided for holding said skis during treatment of the traveling undersides of said skis above said freely rotatable rollers wherein, contact faces of said clamping abutments for said skis are beveled in a wedge-shaped manner and cooperate with clamping jaws.

14. The apparatus of claim 13 wherein said clamping jaws are pneumatically actuated.

* * * * *